US008156597B2

(12) United States Patent
Davis et al.

(10) Patent No.: US 8,156,597 B2
(45) Date of Patent: Apr. 17, 2012

(54) CUSHION ROLL FOR BOWLING LANE CLEANING MACHINE

(75) Inventors: Mark E. Davis, Sebring, FL (US); Anthony K. Crews, Sebring, FL (US)

(73) Assignee: Kegel, LLC., Lake Wales, FL (US)

( * ) Notice: Subject to any disclaimer, the term of this patent is extended or adjusted under 35 U.S.C. 154(b) by 1882 days.

(21) Appl. No.: 11/181,276

(22) Filed: Jul. 14, 2005

(65) Prior Publication Data

US 2007/0011838 A1 Jan. 18, 2007

(51) Int. Cl.
*A47L 11/02* (2006.01)

(52) U.S. Cl. ..... 15/98; 15/50.3; 118/207

(58) Field of Classification Search ..... 15/230, 15/50.1, 50.3, 51, 52, 52.1, 98, 99, 103.5, 15/179, 302, 320; 118/207
See application file for complete search history.

(56) References Cited

U.S. PATENT DOCUMENTS

| | | | | | |
|---|---|---|---|---|---|
| 2,828,501 | A | * | 4/1958 | Brown, Sr. | 15/114 |
| 3,617,555 | A | * | 11/1971 | Ginsburgh et al. | 210/671 |
| 4,121,315 | A | * | 10/1978 | Buser | 15/228 |
| 4,463,469 | A | * | 8/1984 | Green | 15/98 |
| 4,510,642 | A | * | 4/1985 | Ingermann et al. | 15/231 |
| 4,550,467 | A | * | 11/1985 | Johnson et al. | 15/228 |
| 4,562,610 | A | * | 1/1986 | Davis et al. | 15/228 |
| 4,980,815 | A | * | 12/1990 | Davis | 700/11 |
| 5,181,290 | A | * | 1/1993 | Davis et al. | 15/98 |
| 5,185,901 | A | * | 2/1993 | Davis et al. | 15/98 |
| 5,455,977 | A | * | 10/1995 | Caffrey et al. | 15/98 |
| 5,468,568 | A | * | 11/1995 | Kuhn et al. | 428/35.9 |
| 5,681,458 | A | * | 10/1997 | Favret | 210/221.2 |
| 5,729,855 | A | * | 3/1998 | Davis | 15/50.3 |
| 5,935,333 | A | * | 8/1999 | Davis | 118/681 |
| 6,185,776 | B1 | * | 2/2001 | Windmeisser | 15/49.1 |
| 6,319,185 | B1 | * | 11/2001 | Sohl | 493/467 |
| 6,372,134 | B1 | * | 4/2002 | Larsen | 210/242.3 |
| 6,383,290 | B1 | * | 5/2002 | Davis et al. | 118/207 |
| 6,615,434 | B1 | | 9/2003 | Davis et al. | |
| 7,014,714 | B2 | * | 3/2006 | Buckley et al. | 118/323 |
| D530,463 | S | * | 10/2006 | Ambasz et al. | D32/16 |
| 7,223,036 | B2 | * | 5/2007 | Chang | 401/191 |

* cited by examiner

*Primary Examiner* — Randall Chin
(74) *Attorney, Agent, or Firm* — Hovey Williams LLP

(57) ABSTRACT

A bowling lane maintenance machine has a cleaning assembly in which liquid cleaner is deposited on the lane surface at the front of the machine as the machine moves down the lane. Immediately behind the point of application of the cleaning solution, a wiping web assembly spreads the solution across the entire surface of the lane and presses the solution down into the conditioner for subsequent pickup by a suction pickup head behind the wiper web assembly. The web is looped under a backup roll having an exposed fibrous pile face that engages the inside surface of the web while the outside surface engages the lane. The fibrous pile encourages the web to remain in intimate contact with the lane surface at all times while accommodating surface irregularities such as depressions and other variations in lane contour.

12 Claims, 4 Drawing Sheets

CUSHION ROLL FOR BOWLING LANE CLEANING MACHINE

TECHNICAL FIELD

This invention relates to bowling lane maintenance equipment and, more particularly, to improvements in a roll used to backup a soft, absorbent web of material that is pressed against the lane surface during cleaning thereof.

BACKGROUND AND SUMMARY

It is known in the art to use a cushioned backup roll to support a web of soft, absorbent cloth material as the material is pressed against the surface of a bowling lane during cleaning operations. See for example U.S. Pat. No. 6,615,434 assigned to the owner of the present invention and hereby incorporated by reference into the present specification.

The present invention provides an improved backup roll having an exposed fibrous pile face that engages the inside surface of the web of material to provide improved conforming contact between the outside surface of the web and irregularities in the lane surface as the cleaning machine moves along the lane. In a preferred embodiment, the pile face is comprised of countless tufts of generally radially outwardly projecting, relatively short fibers that yield and bend as necessary to enable the outside surface of the web to conform and contact surface irregularities in an intimate manner. Preferably, the fibers are constructed from non-absorbent material and form part of a wrapper that surrounds the roll. The wrapper may be a permanent part of the roll or selectively removable therefrom for replacement or cleaning. Suitable fasteners such as strips of hook and loop material may be utilized to detachably secure the wrapper to the body of the roll. Preferably also, the body of the roll is constructed from a cushion material such as a closed cell polyurethane foam.

DETAILED DESCRIPTION

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

Figure 1:
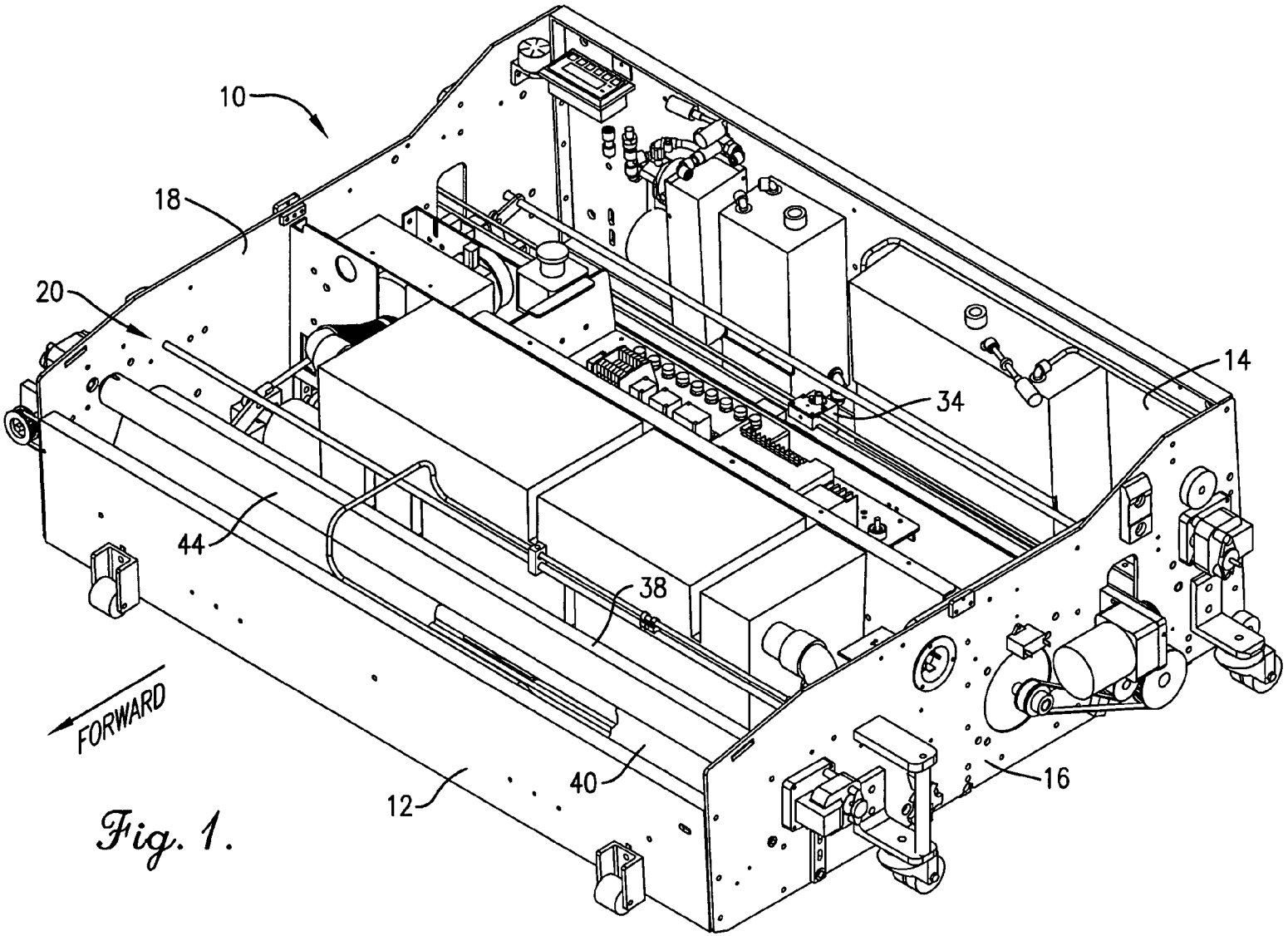
FIG. 1 is a left front perspective view of a bowling lane maintenance machine having a cleaning assembly that utilizes a backup roll in accordance with the principles of the present invention, the cover of the machine being removed.
Figure 2:
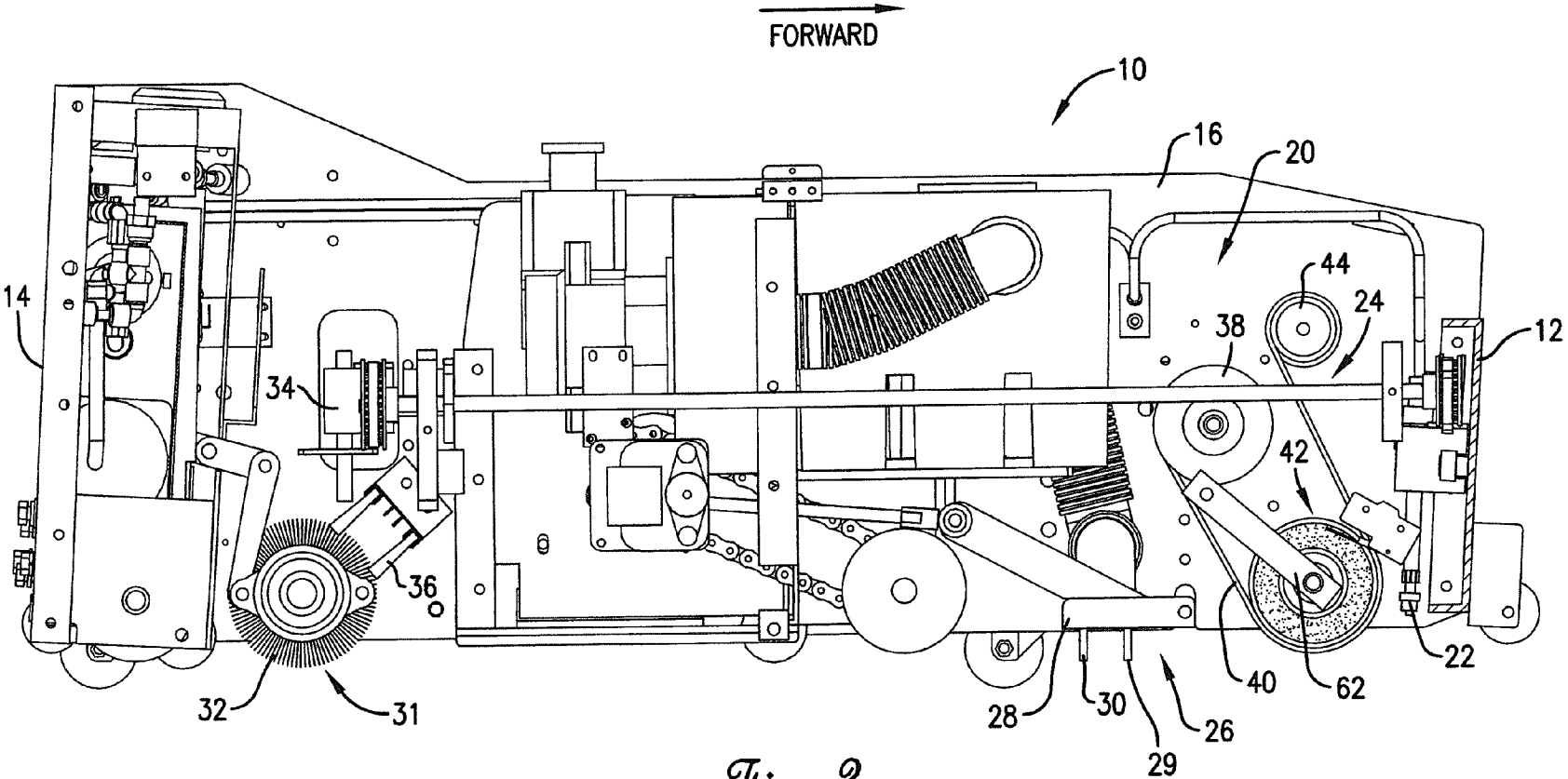
FIG. 2 is a right side elevational view of the machine with the near side wall removed to reveal internal details of construction.

The machine 10 selected for purposes of illustration in FIGS. 1 and 2 is similar to the machine disclosed and claimed in co-pending application Ser. No. 10/818,972 filed Apr. 5, 2004, now U.S. Pat. No. 6,939,404, and titled "Lane Maintenance Machine Having Reciprocating Cleaning Liquid Dispensing Head." Therefore, the '972 application is hereby incorporated by reference into the present specification.

Machine 10 is a combination cleaning and oiling machine, although the principles of the present invention could apply equally as well to a machine which is a single-purpose cleaning machine without the ability to also apply oil. In the illustrated embodiment, the machine 10 includes a mobile housing or chassis provided with a front wall 12, a rear wall 14, and left and right sidewalls 16 and 18 respectively. A cleaning assembly broadly denoted by the numeral 20 is located in the front half of the machine behind front wall 12 and includes, among other things, a cleaning liquid dispensing head 22 that reciprocates back and forth across the width of the machine, laying down a bead of cleaning solution as it reciprocates. Immediately behind dispensing head 22, and forming a part of cleaning assembly 20, is a wiper web assembly 24, the function of which is to spread out the cleaning liquid evenly and meter it in such a way that only a thin film is allowed to pass beneath assembly 24 to a pickup assembly 26 immediately behind wiper web assembly 24. Pickup assembly 26 also comprises part of the cleaning assembly 20 and includes a vacuum pickup head 28 having a pair of transversely extending squeegees 29 and 30 thereon.

The pickup assembly 26 is designed to completely remove the liquid film from the lane surface so that it is substantially dry by the time a conditioner application assembly 31 at the rear of the machine passes over the cleaned area. Conditioner application assembly 31 may take a number of different forms, but in the illustrated embodiment includes a rotating buffer roll 32 to which conditioner is supplied by a transversely reciprocating conditioner dispensing head 34. A transfer brush unit 36 is disposed between dispensing head 34 and buffer roll 32 for the purpose of receiving conditioner directly from dispensing head 34 and spreading it evenly on the periphery of buffer roll 32.

Wiper web assembly 24 includes a supply roll 38 containing a coiled web of soft, absorbent material such as a nonwoven, compressed rayon acrylic material well-known in the industry as "duster cloth." Such material is available from a number of different sources of supply as well-known in the industry. The web 40 is looped beneath a gravity-biased backup roll 42 and then wrapped around an elevated take up roller 44. Periodically, additional lengths of the web 40 are paid out by supply roller 38 and taken up by take up roller 44 to present a fresh stretch of material around the lower periphery of backup roll 42.

In accordance with the present invention, backup roll 42 is provided with an exposed fibrous pile face that engages the inside surface of web 40 while the outside surface thereof engages the lane. Such exposed pile face is represented by the numeral 46 in FIGS. 4 and 5 and is presented by countless tufts 48 of short, individual fibers projecting generally radially outwardly from roll 42. Preferably, the fibers are nonabsorbent and are anchored to a flexible substrate 50 of woven, nonabsorbent material. Collectively, the tufts of fibers 48 and substrate 50 present a wrapper 52 that extends around the entire circumference of backup roll 42. One suitable material for use as wrapper 52 is available from Padco, Inc. of Minneapolis, Minn. as Product Number 20.

In a preferred embodiment, backup roll 42 also includes a tubular metal core 54 and a cylindrical cushion body 56 surrounding core 54 and affixed thereto. Preferably, cushion body 56 is constructed from closed cell polyurethane foam. Wrapper 52 surrounds cushion body 56. Opposite ends of core 54 are provided with hubs 58 and integral stub shafts 60 for rotatably mounting roll 42 on support arms 62 of the wiper web assembly 24.

Figure 3:
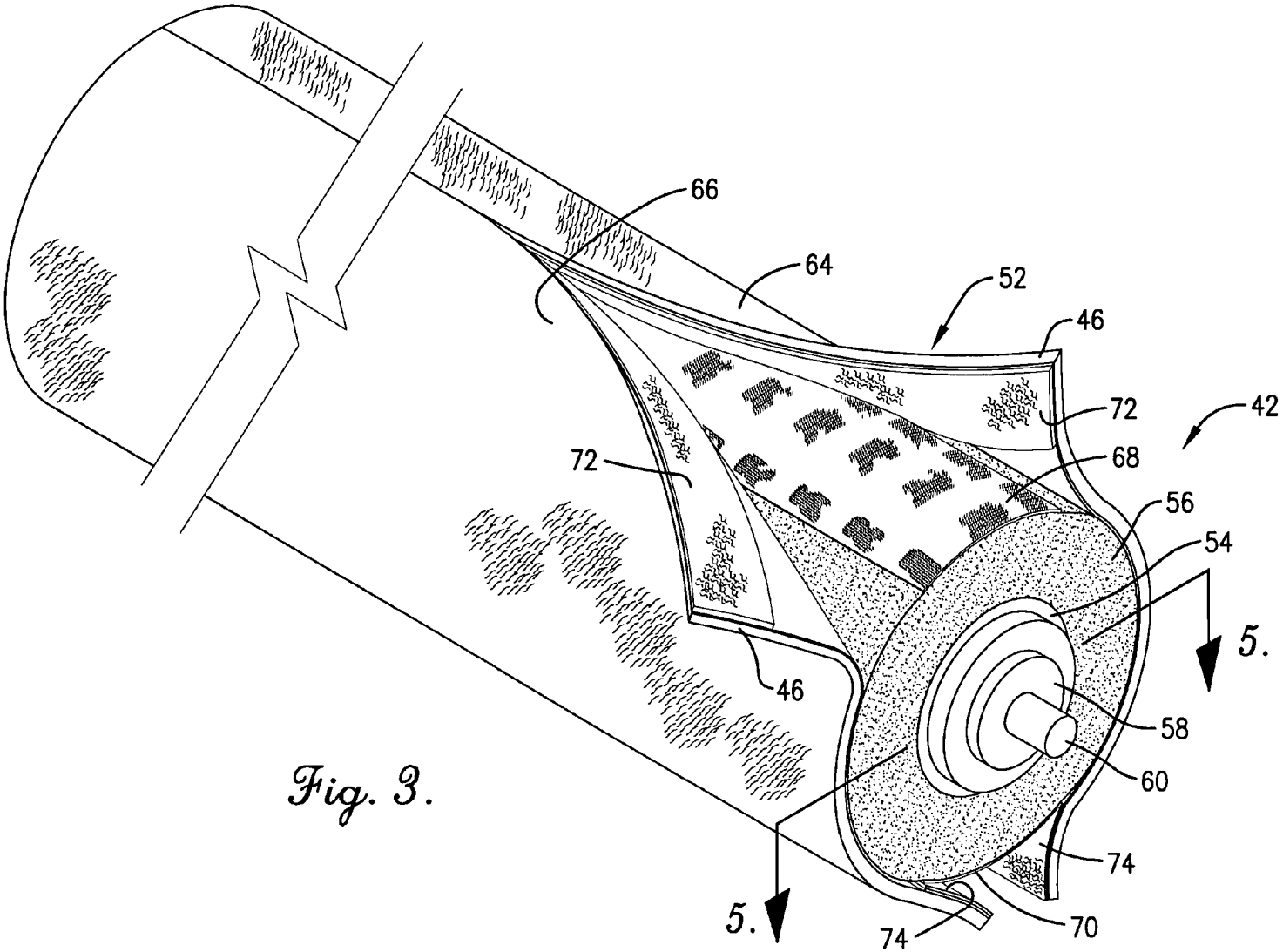
FIG. 3 is an enlarged isometric view of one embodiment of a backup roll constructed in accordance with the principles of the present invention, the wrapper in the illustrated embodiment being comprised of two successive 180° sections and shown partially pulled away from the body of the roll at one end thereof to reveal means of attaching the wrapper to the body.
Figure 4:
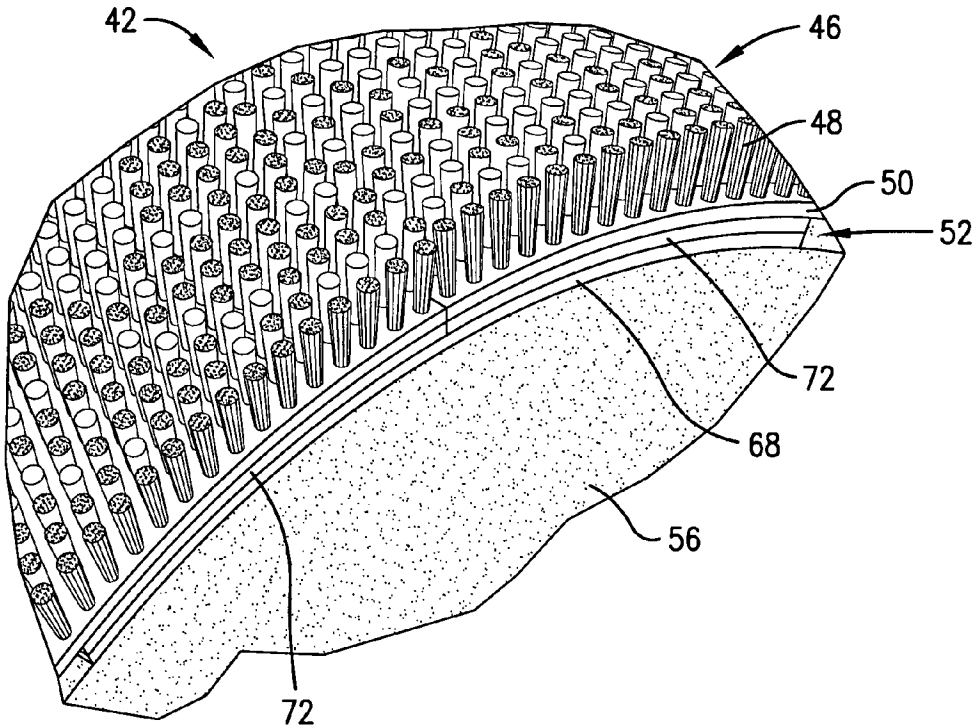
FIG. 4 is an enlarged, fragmentary isometric view of the outer surface of the roll illustrating the fibrous pile face that is presented by countless tufts of fibers projecting outwardly from the circumference of the roll.

Wrapper 52 may be permanently attached to cushion body 56 or selectively removable therefrom. Further, it may comprise a single piece of material or multiple sections. In one preferred form of the invention the wrapper 52 comprises two sections 64 and 66 that cover successive 180° portions of cushion body 56. Preferably, wrapper sections 64 and 66 are detachably secured to cushion body 56 by any suitable means such as, for example, hook and loop fastening material. One such arrangement is illustrated in FIGS. 3 and 4 wherein two wide strips 68 and 70 of hook material are bonded to the periphery of cushion body 56 at diametrically opposed positions and extend the full length thereof. Each wrapper section 64, 66 has a pair of narrower strips 72 and 74 of loop material secured to the inner face thereof along opposite longitudinal edges for interlocking engagement with corresponding portions of hook strips 68 and 70. In this way, wrapper 52 may be completely removed from cushion body 56 and replaced with another complete wrapper or, only one of the wrapper sections 64, 66 may be removed and replaced as necessary.

Figure 5:
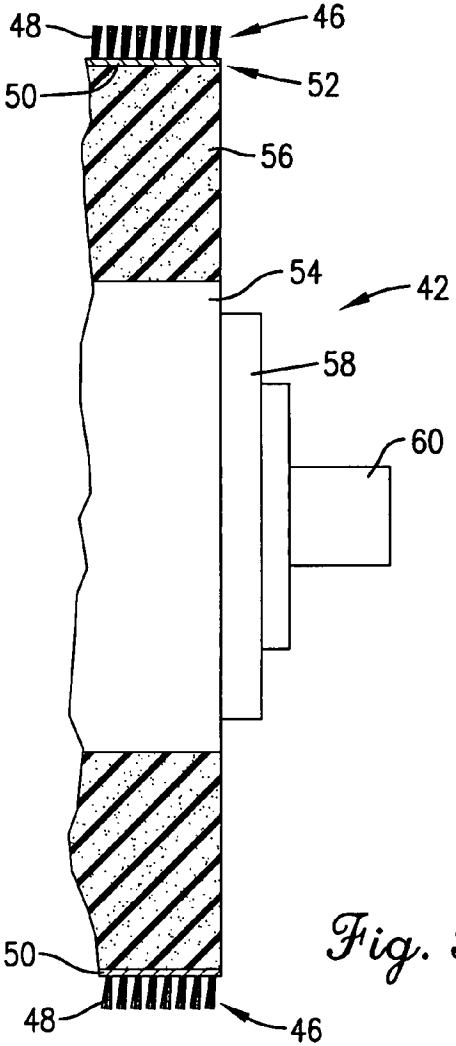
FIG. 5 is a fragmentary cross sectional view of the roll taken substantially along line 5-5 of FIG. 3 and illustrating the slight grain exhibited by the fiber tufts as the tufts are inclined slightly toward one end of the roll in one section of the wrapper and toward the other end of the roll in the opposite section of the wrapper.

It is to be noted that, typically, the tufts of fibers 48 have a slight grain as manufactured; that is, all the tufts tend to lean slightly in a certain direction. Depending upon the way in which the wrapper 52 is placed on cushion body 56, such grain can cause the web 40 to migrate toward one end of the roll 42 as web 40 engages the lane surface during cleaning operations. Accordingly, in a preferred form of the invention, one of the wrapper sections is oriented such that the grain of its fibers is generally directed toward one end of the roll 42, while the other wrapper section is oriented such that the grain of its fibers is directed toward the opposite end of the roll. This is illustrated in FIG. 5 wherein it may be seen that the tufts 48 in the upper portion of the figure lean slightly to the right, while the tufts 48 in the lower portion of the figure lean slightly to the left. By directing the grain oppositely in successive wrapper sections 64 and 66, the web 40 tends to stay properly centered on roll 42 during cleaning operations.

In use, the improved roll 42 provides a backup for the wiping web 40 as it engages the lane surface during cleaning operations. The individual tufts 48 of fibers yield and bend easily in appropriate directions as the outer surface of web 40 encounters irregularities in the lane surface. Thus, web 40 is responsive to such contour changes exactly where it is needed so that web 40 remains in intimate contact with the lane surface at all times. Yet, the wiping action is not so intense that the cleaning liquid is actually picked up by web 40 in large portions. Instead, it is spread out evenly across the lane surface and pushed down into the existing film of oil for subsequent ready pickup by vacuum head 28.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

The invention claimed is:

1. In a bowling lane maintenance machine, the improvement comprising:

a roll; and a web of soft, absorbent material looped under said roll and presenting an outside surface disposed for wiping engagement with the surface of the lane as the machine moves along the lane, said roll having an exposed fibrous pile face engaging an inside surface of said web, said fibrous pile face being presented by tufts of generally radially outwardly projecting fibers, said fibers being non-absorbent.

2. In a bowling lane maintenance machine, the improvement comprising:

a roll; and a web of soft, absorbent material looped under said roll and presenting an outside surface disposed for wiping engagement with the surface of the lane as the machine moves along the lane, said roll having an exposed fibrous pile face engaging an inside surface of said web, said fibrous pile face being constructed from non-absorbent material.

3. In a bowling lane maintenance machine, the improvement comprising:

a roll; and a web of soft, absorbent material looped under said roll and presenting an outside surface disposed for wiping engagement with the surface of the lane as the machine moves along the lane, said roll having an exposed fibrous pile face engaging an inside surface of said web, said roll further having a cushion body and a wrapper of non-absorbent material surrounding said body, said wrapper presenting said exposed fibrous pile face of the roll.

4. In a bowling lane maintenance machine as claimed in claim 3, said fibrous pile face being presented by tufts of generally radially outwardly projecting fibers.

5. In a bowling lane maintenance machine as claimed in claim 3, said wrapper being detachably secured to said cushion body using opposing sections of hook and loop material.

6. In a bowling lane maintenance machine as claimed in claim 5, said wrapper comprising a pair of wrapper sections covering successive 180.degree. portions of the circumference of the roll.

7. In a bowling lane maintenance machine as claimed in claim 6, said fibrous pile face being presented by tufts of generally radially outwardly projecting fibers, the tufts of fibers in one of said wrapper sections having a grain that is directed generally toward one end of the roll, the tufts of fibers in the other of said wrapper sections having a grain that is directed generally toward the opposite end of the roll.

8. A roll for use in a bowling lane maintenance machine comprising:

a cylindrical body of cushion material, the cylindrical body having a circumference;

a wrapper of non-absorbent material surrounding said body, said wrapper having an exposed fibrous pile face, wherein said wrapper extends substantially completely and contiguously around the entire circumference of the cylindrical body.

9. A roll as claimed in claim 8, said fibrous pile face being presented by tufts of generally radially outwardly projecting fibers.

10. A roll for use in a bowling lane maintenance machine comprising:

a cylindrical body of cushion material; and a wrapper of non-absorbent material surrounding said body, said wrapper having an exposed fibrous pile face, said wrapper being detachably secured to said cushion body using opposing sections of hook and loop material.

11. A roll as claimed in claim 10, said wrapper comprising a pair of wrapper sections covering successive 180.degree. portions of the circumference of the roll.

12. A roll as claimed in claim 11, said fibrous pile face being presented by tufts of generally radially outwardly projecting fibers, the tufts of fibers in one of said wrapper sections having a grain that is directed generally toward one end of the roll, and the tufts of fibers in the other of said wrapper sections having a grain that is directed generally toward the opposite end of the roll.

* * * * *